US005241944A

United States Patent [19]

Rappaport

[11] Patent Number: 5,241,944

[45] Date of Patent: Sep. 7, 1993

[54] TOY WEAPON FOR SHOOTING OUT WET PELLETS

[76] Inventor: Mark Rappaport, 1900 Voorhees Ave., Unit C, Redondo Beach, Calif. 90278

[21] Appl. No.: 933,779

[22] Filed: Aug. 24, 1992

[51] Int. Cl.[5] ..... F41B 11/14; F41B 7/08

[52] U.S. Cl. ..... 124/67; 124/27; 222/79

[58] Field of Search ..... 221/135; 222/79; 124/16, 26, 27, 49, 50, 53.5, 59, 65-67, 56, 72

[56] References Cited

U.S. PATENT DOCUMENTS

| | | | |
|---|---|---|---|
| 3,112,109 | 11/1963 | Young | 124/26 X |
| 3,128,753 | 4/1964 | Politzer | 124/26 |
| 3,443,725 | 5/1969 | Lawhorn | 222/79 |
| 3,572,311 | 3/1971 | Baer | 124/50 X |
| 4,565,183 | 1/1986 | Smith | 124/26 |

*Primary Examiner*—Randolph A. Reese
*Assistant Examiner*—John Ricci
*Attorney, Agent, or Firm*—Michael Ebert

[57] ABSTRACT

A toy weapon adapted to shoot out sponge-like pellets impregnated with water. The weapon includes a launching chamber above which is vertically mounted a gravity-feed cartridge loaded with a stack of pellets. Also mounted above the chamber is a pump-operated water supply coupled to the cartridge whereby when the pump is actuated, water is then sprayed into the cartridge to impregnate the pellets therein. Projecting forwardly from the chamber is a gun barrel, while projecting rearwardly therefrom is a cylinder. Slidable within the cylinder is a spring-biased piston joined to a piston rod that extends from the rear end of the cylinder and terminates in a handle. When a player pulls out the handle, the piston is then at its retracted position and the spring is energized; and when the handle is released, the expanding spring then advances the piston toward the front end of the cylinder to produce a force which drives the pellet through the barrel from which it is discharged toward a target in line with the barrel.

12 Claims, 4 Drawing Sheets

TOY WEAPON FOR SHOOTING OUT WET PELLETS

BACKGROUND OF INVENTION

1. Field of Invention

This invention relates generally to toy weapons, and more particularly to a toy gun adapted to shoot out innocuous soft pellets formed of flexible foam plastic material impregnated with water, so that an individual struck by the pellet is made wet thereby.

2. Status of Prior Art

Toy weapons which simulate actual weapons have always been popular with children, for children seek to emulate the activity of adults. However, those weapons which act to shoot out a missile capable of inflicting even slight injury on an individual struck by the missile are not acceptable; for in toys, safety is a primary consideration.

A toy water gun is innocuous and therefore acceptable, for the worst it can do is to wet an individual struck by a stream of water emitted from the gun. One such water gun is disclosed in the Johnson U.S. Pat. No. 4,591,071, in which the gun includes a pump to compress air for applying pressure to water contained in the gun, the water being supplied thereto by a bottle or reservoir attached to the gun. In this arrangement, a trigger-actuated flow control valve acts to control the flow of pressurized water through a nozzle in the barrel of the gun.

From a child's standpoint, a water gun, however elaborate its mechanism, does not simulate the action of a real weapon, for the toy does not shoot out a bullet or missile of some sort, but only a stream of water. Even if the water gun emits pulses of water rather than a continuous stream, this is not equivalent to shooting out a missile. On the other hand, a child who operates a water gun enjoys the fact that if he succeeds in striking a child who is also armed with a water gun and assumes the role of an enemy player, he has thereby humiliated his enemy and is therefore victorious.

A more realistic toy weapon is one that shoots out soft balls of flexible, foam plastic material. While a ball of this type is innocuous, it is functionally equivalent, as it were, to a cannonball or other missile which physically strikes another player and in doing so, scores a hit. A toy weapon of this type is disclosed in the Moorman U.S. Pat. No. 4,892,081, in which a soft ball is squeezed into a cavity at the front end of a gun barrel and is launched by compressed air produced by advancing a plunger toward the ball until the resultant air pressure is such as to overcome the hold of the cavity on the ball squeezed therein.

But in a toy weapon of the Moorman type, the missile shot out of the gun is a dry, soft ball; hence a child struck by this ball is not humiliated by this experience, for the ball simply bounces off the child. The term humiliate is used in the sense of a loss of dignity, and the reason children find water gun games exciting, even though they do not shoot out missiles, is that each player seeks, as best he can, to avoid being made wet and ashamed.

Hence those weapons which act to shoot out dry balls or other dry missiles are more realistic than those which merely wet a target; whereas those which wet a target afford a degree of play satisfaction that is lacking in toy weapons which shoot out dry missiles.

SUMMARY OF INVENTION

In view of the foregoing, the main object of this invention is to provide a toy weapon adapted to shoot out soft and innocuous missiles or pellets that are impregnated with water, thereby combining the advantages of those toy weapons which fire dry missiles and those which only shoot out water.

More specifically, an object of this invention is to provide a toy gun which is loaded with a stack of pellets formed of flexible, foam plastic or other sponge-like material impregnated with water, the pellets being successively fired from the gun.

A significant advantage of the invention is that the toy gun need not be reloaded with a soft missile each time a missile is fired, for the gun includes a cartridge loaded with a stack of soft, wet missiles; and when a missile is fired from a launching chamber, another missile drops into the chamber in readiness to be fired.

Also an object of this invention is to provide a toy gun of the above type which is safe to use and which can be manufactured at relatively low cost.

Briefly stated, in one embodiment of the invention these objects are attained in a toy weapon adapted to shoot out sponge-like pellets impregnated with water. The weapon includes a launching chamber above which is vertically mounted a gravity-feed cartridge loaded with a stack of pellets. Also mounted above the chamber is a pump-operated water supply coupled by a tube to the cartridge whereby when the pump is actuated, water is then sprayed into the cartridge to impregnate the pellets therein. Projecting forwardly from the chamber is a gun barrel, while projecting rearwardly therefrom is a cylinder. Slidable within the cylinder is a spring-biased piston joined to a piston rod that extends from the rear end of the cylinder and terminates in a handle.

When a player pulls out the handle, the piston is then at its retracted position and the spring is compressed; and when the handle is released, the expanding spring then advances the piston toward the front end of the cylinder. Projecting from the piston through the chamber and into the barrel is a launching bolt which in the retracted position of the piston cleans the chamber to permit the lowermost wet pellet in the stack to drop therein. When the handle is released, the bolt then drives this pellet through the barrel from which it is discharged toward a target in line with the barrel.

In another embodiment of the invention, the arrangement is such as to pneumatically drive the pellet by a blast of air produced by the advancing piston, thereby obviating the need for a launching bolt to mechanically drive the wet pellet.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Weapon Structure

Figures 1, 2:
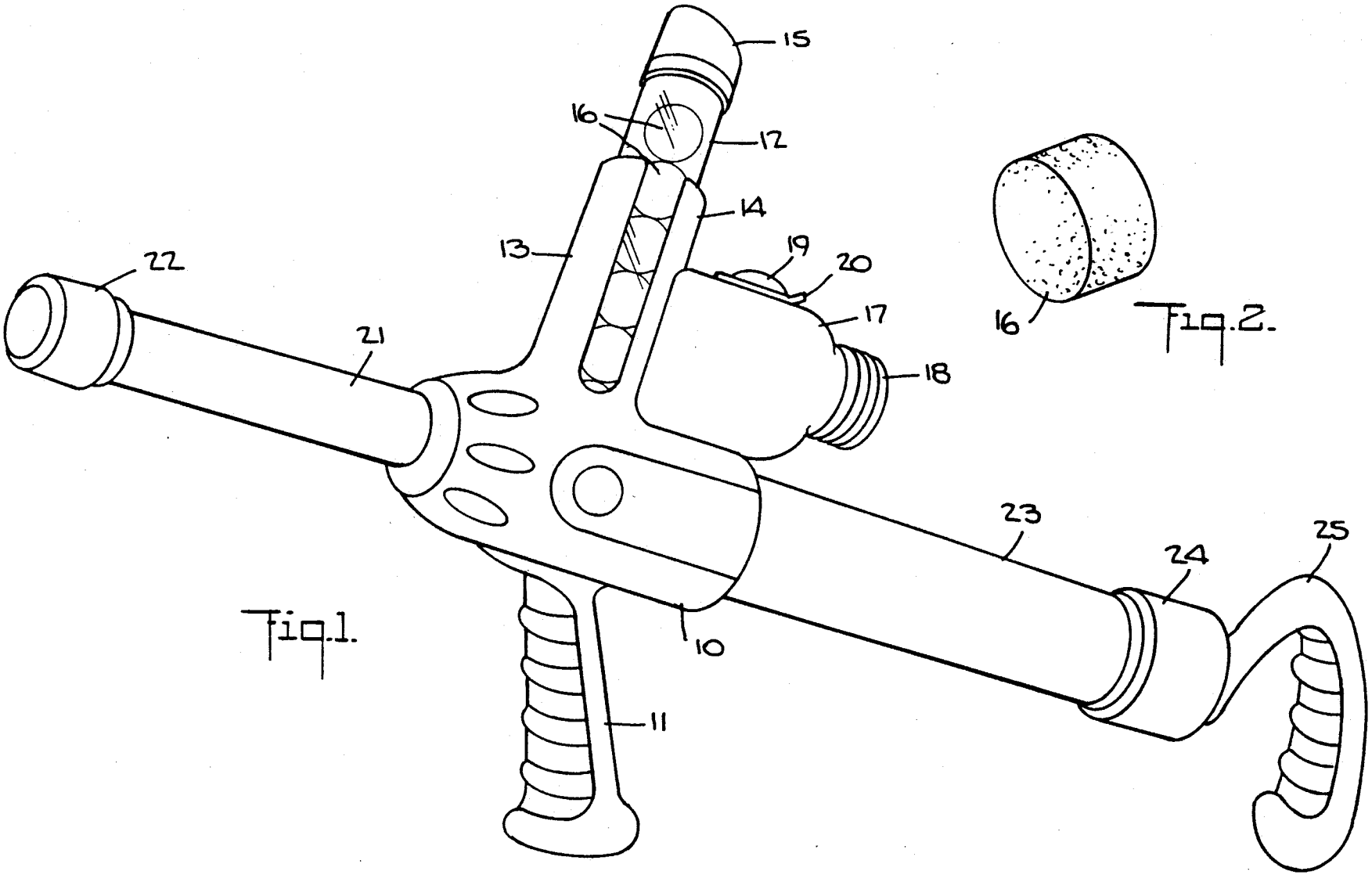
FIG. 1 is a perspective view of a toy weapon in accordance with the invention.
FIG. 2 illustrates a pellet of the type serving as the missile for the weapon.

Referring now to FIG. 1, there is shown a toy weapon in accordance with one embodiment of the invention, the weapon being in a gun format and being adapted to fire sponge-like pellets successively out of its barrel.

The gun includes a launching chamber 10 having attached to its underside a hand grip 11. Mounted vertically above chamber 10 is a gravity-feed cartridge 12 formed of transparent plastic material to expose the pellets loaded therein. The cartridge is socketed by a pair of opposing arms 13 and 14 which are integral with the chamber and have a curvature which conform to the curved wall of the cartridge. The structure of the gun is preferably molded of a high-strength, synthetic plastic material, such as polyethylene or polypropylene Cartridge 12 is provided at its top end with a removable cap 15 so that it can be loaded with a stack of pellets 16. As shown separately in FIG. 2, each pellet is constituted by a small, drum-shaped body of sponge-like material. The pellets may be formed of flexible foam plastic material, such as polyurethane of the open-cell type or cellulosic or other material having sponge-like properties capable of absorbing water or other liquids.

Also mounted above chamber 10 adjacent arm 14 is a pump-operated water supply in the form of a plastic bottle 17 having integrated therewith a bellows-type pump 18, the pump being located on the side of the bottle opposed to the side adjacent arm 14. Bottle 10 is provided at its top with a detachable stopper 19 which is linked to the bottle by a flexible strap 20.

Projecting forwardly from chamber 10 is a gun barrel 21 whose front end has a collar 22 attached thereto. Projecting rearwardly from chamber 10 in axial alignment with barrel 21 is a cylinder 23 terminating in a closure cap 24. Also provided is a handle 25 for operating the gun.

Figure 3:
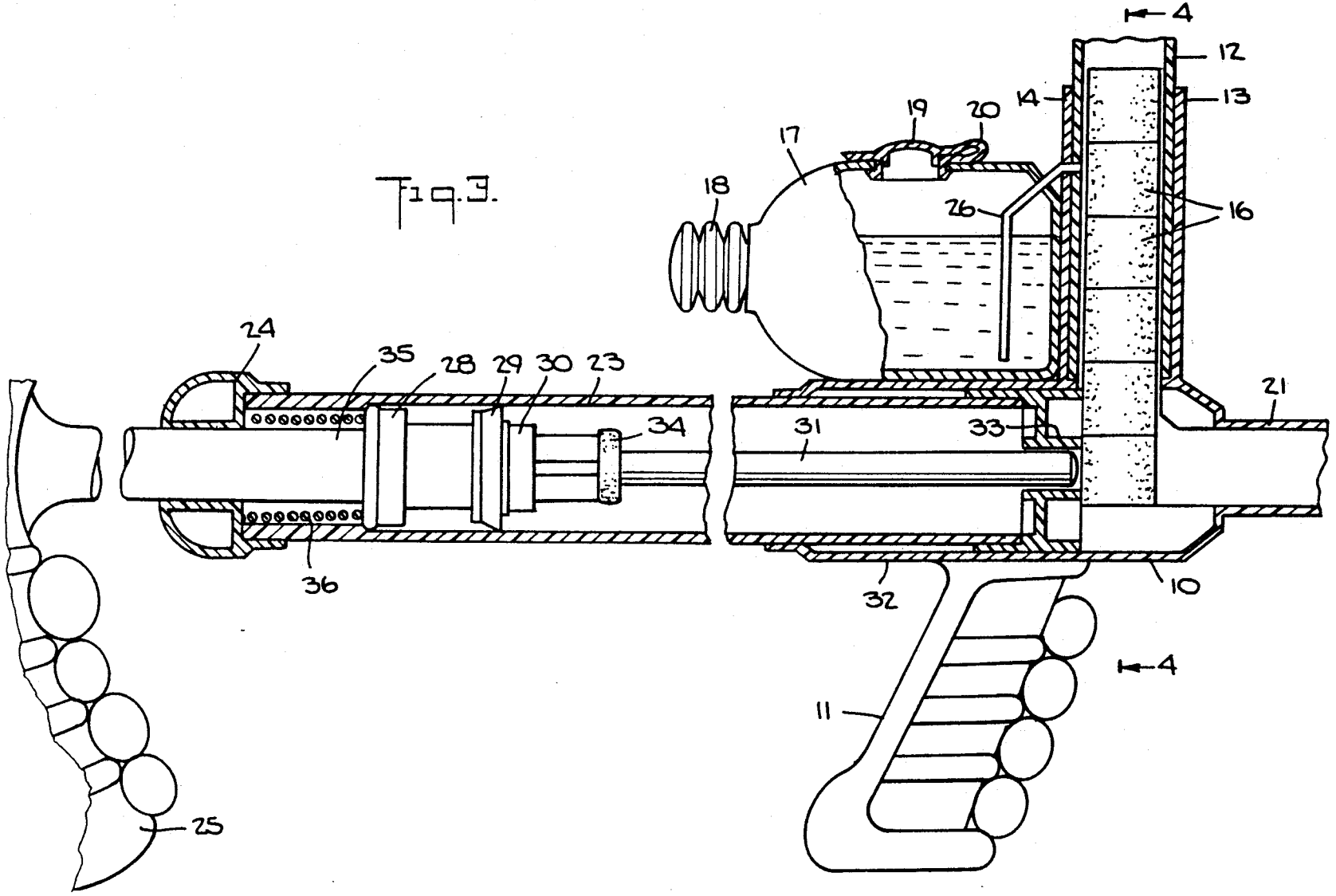
FIG. 3 is a sectional view showing the internal mechanism of the weapon.
Figure 4:
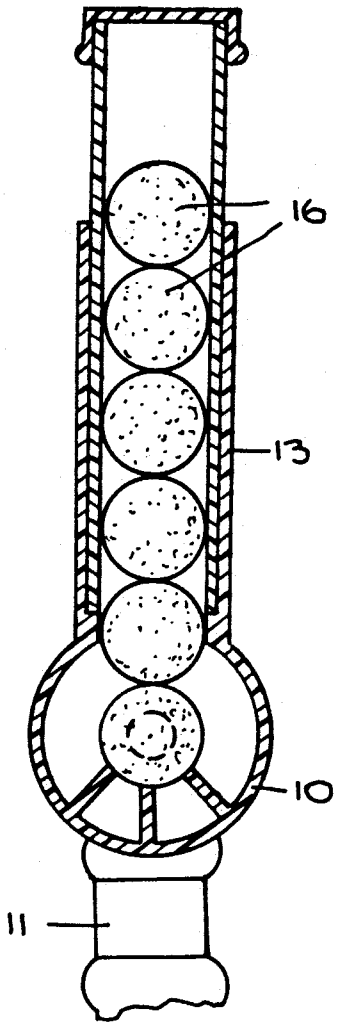
FIG. 4 is a section taken in the plane indicated by line 4—4 in FIG. 3.

As shown in FIG. 3, inserted in bottle 17, which is filled with water, is a dip tube 26. Tube 26 extends out of the bottle, its outlet being attached to cartridge 12 at a point below the upper end thereof. Hence when a player actuates pump 18, this subjects the water in the bottle to pressure to force the water up dip tube 26, the water emitted from the outlet being sprayed into the cartridge to wet pellets 16 in the stack that are below the entry point of the water spray.

Slidable in cylinder 23 is a piston assembly formed by a pair of interlinked piston elements 28 and 29 having resilient flanges which engage the inner surface of cylinder 23 and a disc-shaped mount 30 joined to piston 29. Integral with mount 30 and projecting axially therefrom is a launching bolt 31 that passes through chamber 10 into barrel 21, the bolt being coaxial with the barrel.

The front end of cylinder 23 is socketed in a coupler 32 at the input side of chamber 10. Nested within coupler 32 is a thrust bearing 33 through which bolt 31 is slidable. Secured to mount 30 is a resilient gasket 34 which, when the piston assembly is adjacent the front end of cylinder 23, it then engages the hub of bearing 33.

Figure 5:
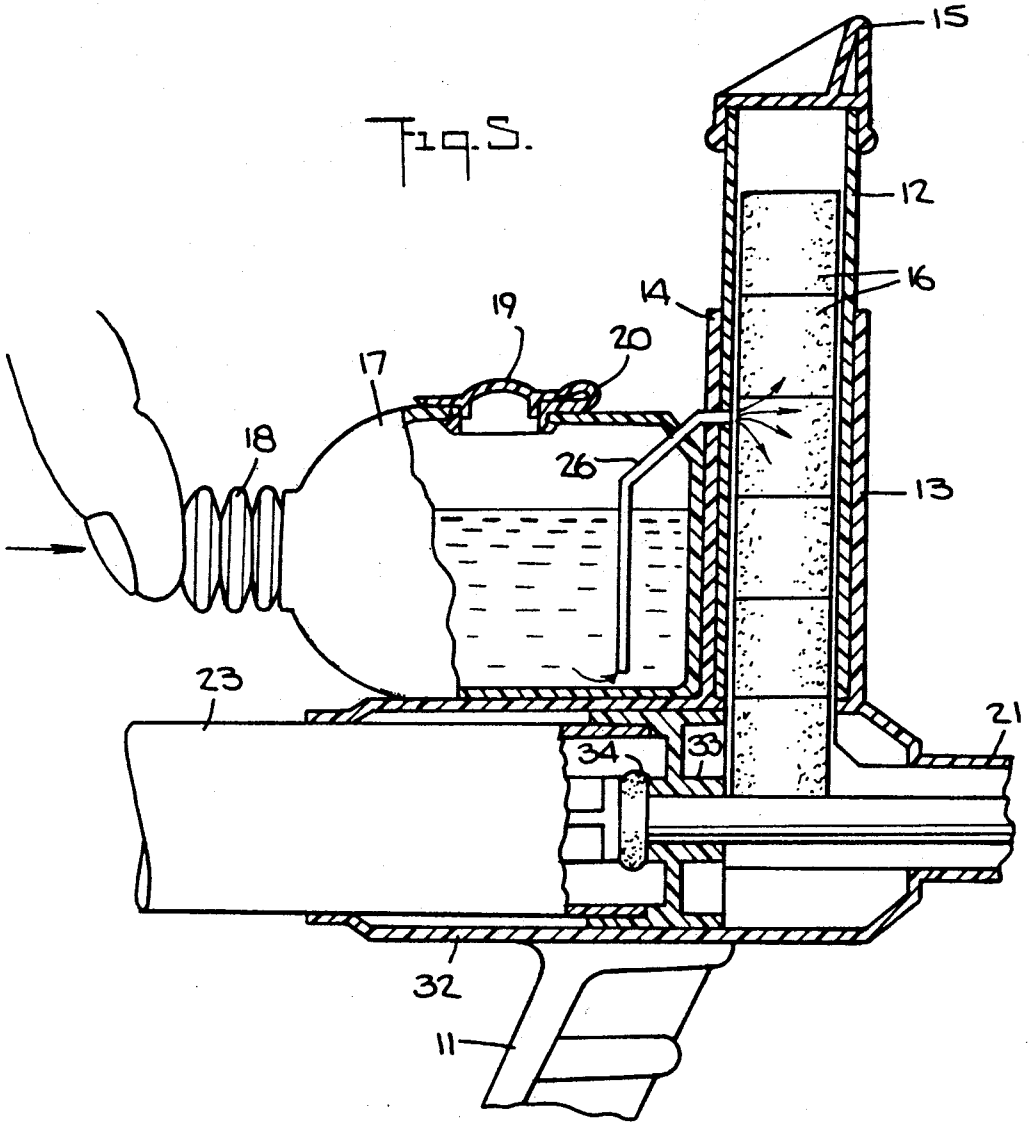
FIG. 5 shows how the pump of the water supply is operated to spray water into the cartridge to wet pellets loaded therein.

Piston element 28 of the piston assembly is joined to one end of piston rod 35 whose other end terminates in handle 25. Surrounding piston rod 35 within cylinder 23 is a compressible helical spring 36. The spring is interposed between piston element 28 of the piston assembly and closure cap 24 attached to the rear end of the cylinder. Spring 26 normally urges the piston assembly to its in-stroke position shown in FIG. 5, in which gasket 34 engages the hub of bearing 33.

When, however, a player pulls out handle 25 so that spring 36 is then compressed as the piston assembly is shifted to a retracted position adjacent the rear end of cylinder 23, then launching bolt 31 is retracted, as shown in FIG. 3, to clear the launching chamber to allow the lowermost wet pellet in the cartridge stack to drop into the chamber. In this state, the tip of launching bolt 31 is adjacent the side of pellet 16 then in place in the chamber, as shown in FIG. 3.

Figures 6, 7:
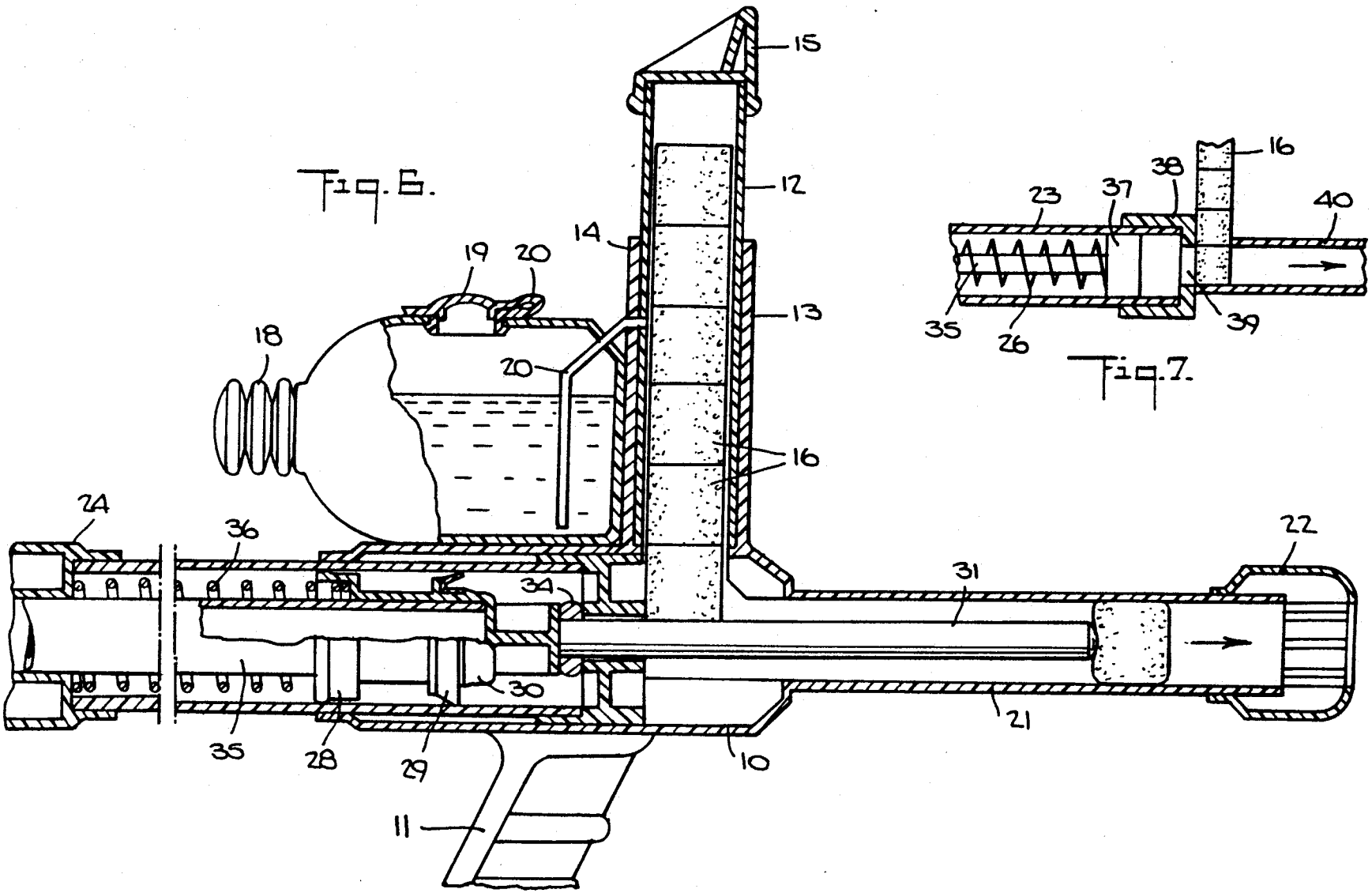
FIG. 6 is a sectional view of the weapon after it has been fired.
FIG. 7 is a section taken through a modified toy weapon.

When the player then releases handle 25, the piston assembly is urged by the expanding spring toward the front end of cylinder 23, and the launching bolt at high velocity drives the wet pellet then in the launching chamber through barrel 21 from which it is discharged toward a target in line with the barrel, as shown in FIG. 6.

Weapon Operation

In operating the weapon, a player first loads cartridge 12 with a stack of dry pellets 16. He then activates pump 18 to spray water into the cartridge so as to wet those pellets in the stack which lie below the entry point of the spray. The gun is now in condition to be fired.

At this point, the lowermost wet pellet 16 in the fully loaded stack thereof in the cartridge rests on bolt 31 which passes through launching chamber 10 into barrel 21. In order to fire this pellet, the player must pull out handle 25 as far as it will go. This action causes launching bolt 31 to clear the launching chamber to permit the lowermost wet pellet in the stack loaded in the gravity-feed cartridge to drop into chamber 10, this pellet being then adjacent the tip of the launching bolt. The second pellet in the stack now rests on top of the first pellet.

The player then releases the handle, causing the advancing bolt to drive the first pellet through the barrel from which it is discharged. Before releasing the handle, the player aims the barrel at a selected target, so that when the handle is released and the pellet is fired, it is directed toward this target.

After the first pellet is discharged, the second wet pellet in the stack now rests on bolt 31; for the bolt, after the gun is fired, again extends through the launching chamber into the barrel. In order, therefore, to fire the next pellet, the handle must again be pulled out to permit it to drop into the launching chamber. This operation is repeated for the remaining pellets in the stack.

Since the cartridge is transparent, the player can see how many pellets remain in the stack. And when the stack is low so that the remaining pellets are dry—for only those in the full stack below the spray point have been wetted—he can again actuate pump 18 to wet the pellets remaining in the stack before they are fired. And when all of the pellets in the cartridge are discharged, the cartridge is then reloaded.

In practice, use may be made of water dyed by an innocuous, water-soluble coloring agent, so that when an opposing player is struck by a wet pellet, he is made conspicuously wet with, say, a blood-tinted liquid. The nature of the colored liquid should be such that it can readily be washed off by soapy water and not permanently stain clothing.

The pellets may be in any usable form and need not be drum-shaped as shown. And, in practice, the plastic pellets may be in different colors to distinguish the ammunition used by one player from that used by another.

Modified Weapon Structure

In the embodiment of the toy weapon shown in FIGS. 1 to 6, wet pellets 16 loaded into cartridge 12 fall one-by-one into launching chamber 10, each pellet being driven into the barrel of the gun when the player who has retracted handle 25 then releases it, the advancing piston assembly causing launching bolt 31 to strike the pellet in the launching chamber to drive it through the barrel from which it is discharged. Hence the pellets in this embodiment are mechanically driven.

The modified weapon structure shown somewhat schematically in FIG. 7 is similar to that in FIGS. 1 to 6 and includes a pump-operated water supply for the cartridge in which the dry pellets are loaded as well as a cylinder 23 and a piston rod 35 terminating in a handle and surrounded by a helical spring 26.

However, in the modified weapon arrangement, piston rod 35 is connected to a piston 37 which slides along the inner surface of cylinder 23, but so engages this surface as to minimize air leakage. Hence as the piston advances, it compresses the air between the piston and a cap 38 attached to the front end of cylinder 23. Cap 38 is provided with a central air port 39 which is blocked by the lowermost wet pellet 16 dropped from the cartridge into the launching chamber. A barrel 40 is coupled to the output of this chamber.

When, therefore, the handle of the weapon is pulled back by the player to retract piston 37 and in doing so compresses spring 36, and the handle is then released, the piston is advanced at a high velocity by the expanding spray toward front end collar 38. The advancing piston abruptly compresses the air between the piston and the wet pellet blocking air port 39 in collar 38. The resultant pulse of compressed air acts to propel pellet 16 through barrel 40 from which it is discharged. When a pulse of air fires the lowermost pellet, the next pellet in the stack drops into place in the launching chamber.

Hence the modified toy weapon is pneumatically rather than mechanically fired, but in all other respects it is the same as the weapon shown in FIGS. 1 to 6.

While there have been shown and described preferred embodiments of a toy weapon for shooting out wet pellets in accordance with the invention, it will be appreciated that many changes and modifications may be made therein, without, however, departing from the essential spirit thereof. Thus instead of a compressible helical spring which is compressed and energized when the piston is retracted, one may use an extendible spring or rubber or other elastomeric material which is energized when the spring is stretched.

I claim:

1. A toy weapon adapted to fire wet, sponge-like pellets, said weapon comprising:

(a) a launching chamber above which is vertically mounted a gravity-feed cartridge loaded with a stack of said pellets;

(b) means to wet the pellets in the cartridge, whereby the lowermost pellet in the stack which drops into the chamber is wet;

(c) a gun barrel projecting forwardly from said chamber;

(d) a cylinder having a front end and a rear end in axial alignment with said barrel, said cylinder projecting rearwardly from the chamber; and (e) a spring-biased piston slidable in said cylinder and joined to a piston rod which extends from the rear end of the cylinder and terminates in a handle; whereby when the piston is pulled out by the handle and is shifted toward the rear end of the cylinder, the spring is then energized, and when the handle is thereafter released, the spring then acts to drive the piston toward the front end of the cylinder to produce a force which drives the pellet then in the chamber through the barrel from which it is discharged.

2. A toy weapon as set forth in claim 1, wherein said force is a pulse of compressed air which is produced when the piston is driven toward the front end of the cylinder.

3. A toy weapon as set forth in claim 1, wherein said spring is a helical spring confined within said chamber, said spring normally urging the piston toward the front end of the cylinder and being compressed and energized when the piston is retracted.

4. A toy weapon as set forth in claim 1, wherein said pellet is formed of flexible, foam plastic material.

5. A weapon as set forth in claim 1, wherein said means to wet the pellets include a water bottle mounted above the chamber adjacent the cartridge, said bottle being provided with a manually-operated pump and a dip tube which extends from the bottle to the cartridge, whereby when the pump is actuated, the water in the bottle is forced up the dip tube into the cartridge to spray pellets therein.

6. A weapon as set forth in claim 5, wherein said bottle is provided with a removable stopper, and said cartridge is provided with a removable cap.

7. A weapon as set forth in claim 1, in which the pellets are drum shaped.

8. A weapon as set forth in claim 1, wherein said cartridge is formed of transparent, synthetic plastic material.

9. A weapon as set forth in claim 1, further including a grip attached to the underside of said chamber, whereby a player, while holding the grip in one hand, can with his other hand pull out the handle.

10. A weapon as set forth in claim 1, further including a launching bolt joined to the piston and projecting therefrom, the bolt passing through said chamber into said barrel, whereby when the piston is pulled out by said handle, said piston is shifted toward the rear end of the cylinder and said spring is energized, the launching bolt then clearing the chamber to permit the lowermost pellet in the stack to drop into said chamber; and when the handle is thereafter released, the spring then acts to drive the piston toward the front end of the cylinder to cause the bolt to push the pellet through the barrel and thereby fire the pellet.

11. A weapon as set forth in claim 10, wherein said piston is joined to a disc-shaped mount from which said launching bolt projects.

12. A weapon as set forth in claim 11, wherein said chamber is provided with a coupler to socket the front end of the cylinder, within which coupler is nested a thrust bearing to receive said bolt, said bearing having a hub, and a resilient gasket supported on the mount which engages said hub when said piston is adjacent the front end of the cylinder.

* * * * *